US009120208B2

(12) United States Patent
Johnson et al.

(10) Patent No.: US 9,120,208 B2
(45) Date of Patent: Sep. 1, 2015

(54) HANDLED RATCHETING TOOL WITH A FLIP OUT HANDLE

(75) Inventors: Ronald L. Johnson, San Jose, CA (US); Yugen Patrick Lockhart, Palo Alto, CA (US)

(73) Assignee: WAGIC, INC, San Jose, CA (US)

( * ) Notice: Subject to any disclaimer, the term of this patent is extended or adjusted under 35 U.S.C. 154(b) by 0 days.

(21) Appl. No.: 12/573,709

(22) Filed: Oct. 5, 2009

(65) Prior Publication Data

US 2011/0079115 A1 Apr. 7, 2011

(51) Int. Cl.

| | |
|---|---|
| ***B25B 15/04*** | (2006.01) |
| ***B25B 23/16*** | (2006.01) |
| ***B25G 1/00*** | (2006.01) |

(52) U.S. Cl.

CPC ..... *B25B 15/04* (2013.01); *B25G 1/005* (2013.01); *Y10T 29/49826* (2015.01)

(58) Field of Classification Search

CPC ..... B25B 13/16; B25B 15/00; B25B 15/02; B25B 15/004; B25B 15/04; B25G 1/00; B25G 1/005; B25G 1/043; B25G 1/046; B25G 1/105; Y10T 29/49826

USPC ..... 81/60, 62, 63.2, 177.5, 177.6, 177.7, 81/63.1

See application file for complete search history.

(56) References Cited

U.S. PATENT DOCUMENTS

| | | | | |
|---|---|---|---|---|
| 244,309 | A | | 7/1881 | Rhodes |
| 363,331 | A | | 5/1887 | Hammer |
| 364,422 | A | | 6/1887 | Laforge |
| 580,235 | A | | 4/1897 | Strum |
| 647,528 | A | | 4/1900 | Schmidt |
| 763,745 | A | | 6/1904 | Gheen |
| 873,363 | A | | 12/1907 | Ross |
| 875,493 | A | | 12/1907 | Beard |
| 959,408 | A | | 5/1910 | Volbert |
| 1,000,900 | A | | 8/1911 | Dorsey |
| 1,006,679 | A | | 10/1911 | Rice |
| 1,100,070 | A | | 6/1914 | Graham |
| 1,172,656 | A | | 2/1916 | Yorgensen |
| 1,187,842 | A | | 6/1916 | Kaas |
| D53,597 | S | | 7/1919 | Marcmann |
| 1,337,769 | A | | 4/1920 | Hemming |
| 1,398,583 | A | | 11/1921 | Bovee |
| 1,425,270 | A | | 8/1922 | Morgan |
| 1,500,852 | A | | 7/1924 | Shepard |
| 1,502,044 | A | * | 7/1924 | McCann ..... 81/62 |
| 1,530,905 | A | | 3/1925 | Nance |
| 1,559,097 | A | | 10/1925 | Hill |
| 1,753,026 | A | | 4/1930 | Rosati |
| 1,825,936 | A | | 10/1931 | Bodmer |
| 1,888,222 | A | | 11/1932 | Curtis et al. |

(Continued)

FOREIGN PATENT DOCUMENTS

| | | |
|---|---|---|
| CA | 1 147 176 | 5/1983 |
| CA | 1232781 A | 2/1988 |

(Continued)

*Primary Examiner* — Hadi Shakeri

(74) *Attorney, Agent, or Firm* — Haverstock & Owens LLP

(57) ABSTRACT

A handled ratcheting tool is able to be used in a standard, L handle or T handle orientation. The handled ratcheting tool includes a handle, a stem, a ratcheting mechanism and multiple tools. Multiple tools are coupled to the ratcheting mechanism which are able to form the L and T configurations depending on which tools are positioned in an open position and which are in a closed position.

23 Claims, 8 Drawing Sheets

(56) References Cited

U.S. PATENT DOCUMENTS 1,915,245 A 6/1933 Cook
1,944,606 A 1/1934 Little
1,970,409 A 8/1934 Wiedemann
2,236,333 A 3/1941 Cowles
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartley
2,465,152 A * 3/1949 Ellison ..... 81/177.5
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,636 A 12/1950 Minnich
2,569,069 A 9/1951 Motel
2,590,307 A 3/1952 Gibson
2,593,828 A 4/1952 Arey
2,604,211 A 7/1952 Steine
2,701,052 A 2/1955 Martel
D175,056 S 6/1955 Wilson
2,715,028 A 8/1955 Dossie
2,719,042 A 9/1955 Epsy
2,726,091 A 12/1955 Topar
2,776,589 A 1/1957 Gregory
2,778,396 A * 1/1957 Swain ..... 81/60
D179,979 S 4/1957 Noga
2,800,816 A 7/1957 Tasciotti
2,804,970 A 9/1957 Kuc et al.
2,810,472 A 10/1957 Midkiff
2,836,210 A 5/1958 Garofalo
2,842,020 A 7/1958 Tarquinio
2,844,244 A 7/1958 Hanson
2,854,741 A 10/1958 Chogler
2,878,701 A 3/1959 Weersma
3,023,054 A 6/1960 Shigekuni
3,061,927 A 11/1962 Von Frankenberg Und Ludwigsdorf
3,113,479 A 12/1963 Swingle
3,156,143 A 11/1964 Wolf
3,222,959 A 12/1965 Clark
3,255,792 A 6/1966 Beck
3,257,991 A 6/1966 Mosch
D205,745 S 9/1966 Nannfeldt
3,342,229 A * 9/1967 Janes ..... 81/177.6
3,343,434 A 9/1967 Schroeder
3,370,696 A 2/1968 Groe
3,424,039 A 1/1969 Scott
3,592,086 A 7/1971 Derwin
3,654,975 A 4/1972 Ballsmith et al.
3,667,518 A 6/1972 Stillwagon, Jr.
3,802,286 A 4/1974 Winklhofer et al.
3,863,693 A 2/1975 Carriker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jansson et al.
4,235,269 A 11/1980 Kraus
4,238,862 A 12/1980 Leatherman
4,241,773 A 12/1980 Personnat
4,302,990 A 12/1981 Chrichton et al.
4,308,770 A 1/1982 Mac Donald
4,327,790 A 5/1982 Stevens et al.
4,384,499 A 5/1983 Shockley
D270,024 S 8/1983 Chan
4,424,728 A 1/1984 Mac Donald
4,448,097 A 5/1984 Rocca
4,469,109 A 9/1984 Mehl
4,476,751 A 10/1984 Mishima
4,525,889 A 7/1985 Dunau
4,542,667 A * 9/1985 Jang ..... 81/177.6
D284,810 S 7/1986 Kelemen, Sr.
4,598,822 A 7/1986 Hemmings
4,640,155 A 2/1987 Condon
4,699,020 A 10/1987 Bush et al.
4,699,030 A 10/1987 Yang
4,703,673 A 11/1987 Allen
4,711,353 A 12/1987 Rozmestor
4,716,795 A 1/1988 Corona et al.
4,716,796 A 1/1988 Corona et al.
4,767,006 A 8/1988 Wasem
4,783,867 A 11/1988 Tsao
4,787,276 A 11/1988 Condon
4,815,346 A 3/1989 Littlehorn
4,819,523 A 4/1989 Souza
4,819,800 A 4/1989 Wilson
4,820,090 A 4/1989 Chen
D302,102 S 7/1989 Amagaya
4,882,841 A 11/1989 Margolis
4,922,569 A 5/1990 Brinker et al.
4,926,721 A 5/1990 Hsia
D308,462 S 6/1990 Komatsu
4,934,223 A 6/1990 Wong
D310,770 S 9/1990 Zamarripa
D311,124 S 10/1990 Learney
4,960,016 A 10/1990 Seals
4,974,477 A 12/1990 Anderson
4,979,407 A 12/1990 Hernandez et al.
5,029,707 A 7/1991 Feng
5,036,975 A 8/1991 Chow
5,062,173 A 11/1991 Collins et al.
5,063,796 A 11/1991 Gennep
5,065,487 A 11/1991 Yother
5,086,674 A 2/1992 Her
5,146,815 A 9/1992 Scott, III
5,147,038 A 9/1992 Pergeau
D333,769 S 3/1993 Jureckson
D334,516 S 4/1993 Tsunoda
D339,048 S 9/1993 Baum
5,251,352 A 10/1993 Cullison
5,263,389 A 11/1993 Frazell et al.
5,265,504 A 11/1993 Fruhn
D342,433 S 12/1993 Sorenson
5,271,300 A 12/1993 Zurbuchen et al.
D343,106 S 1/1994 Eklind et al.
5,295,422 A 3/1994 Chow
5,320,004 A 6/1994 Hsiao
5,329,834 A 7/1994 Wong
5,394,984 A 3/1995 Aiba
D359,671 S 6/1995 Acosta
5,450,774 A 9/1995 Chang
5,450,775 A 9/1995 Kozak
5,461,950 A 10/1995 Iwinski
D365,681 S 1/1996 Chow
5,480,166 A 1/1996 Milsop
5,495,942 A 3/1996 Izhak
5,499,560 A 3/1996 Aeschliman
5,499,562 A 3/1996 Feng
5,505,316 A 4/1996 Lee
5,517,885 A 5/1996 Feng
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
D380,131 S 6/1997 Sung
D382,190 S 8/1997 Blackston et al.
5,653,525 A 8/1997 Park
D383,048 S 9/1997 Sorensen et al.

(56) References Cited

U.S. PATENT DOCUMENTS 5,662,013 A 9/1997 Lin
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A * 1/1998 Anderson et al. ..... 81/440
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,768,960 A 6/1998 Archuleta
5,791,211 A 8/1998 Bondhus et al.
5,803,584 A 9/1998 Chung
5,816,401 A 10/1998 Vasudeva et al.
5,820,288 A 10/1998 Cole
5,822,830 A 10/1998 Lin
D400,775 S 11/1998 Hsu
5,855,274 A 1/1999 Piao
D405,335 S 2/1999 Lin
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D420,885 S 2/2000 Lin
6,032,332 A 3/2000 Lin
6,032,796 A 3/2000 Hopper et al.
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Bondhus et al.
6,131,740 A 10/2000 Huang
D433,613 S 11/2000 Jialin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 * 7/2001 Anderson et al. ..... 81/440
6,279,434 B1 8/2001 Brown
6,279,435 B1 * 8/2001 Zayat, Jr. ..... 81/177.7
D448,267 S 9/2001 Jean et al.
6,308,599 B1 10/2001 Fu-Hui
6,311,587 B1 11/2001 Johnson et al.
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 3/2004 Hu
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johnson et al.
D494,438 S 8/2004 Flakenstein et al.
6,799,490 B1 10/2004 Chu
6,827,210 B2 12/2004 Chen
6,863,471 B2 3/2005 Medendorp
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al.
6,948,406 B1 9/2005 Li
6,968,758 B2 11/2005 Lin
6,988,616 B2 1/2006 Chen
D517,391 S 3/2006 Leins
7,028,593 B1 4/2006 Lin et al.
7,047,847 B2 5/2006 Chuang
7,051,626 B1 5/2006 Chen
7,051,629 B2 5/2006 Huang
D523,637 S 6/2006 Chang
7,073,418 B2 7/2006 Kuo
7,080,582 B2 7/2006 Karle
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,185,565 B1 3/2007 Hu
7,216,569 B2 * 5/2007 Abdelgany ..... 81/177.5
7,237,463 B1 7/2007 Lee
D548,464 S 8/2007 Lin
D549,069 S 8/2007 Lin et al.
7,281,454 B2 10/2007 Johnson et al.
7,284,466 B1 10/2007 Ho

(56) References Cited

U.S. PATENT DOCUMENTS

| | | | | |
|---|---|---|---|---|
| D557,099 | S | 12/2007 | Lin | |
| 7,305,908 | B2 | 12/2007 | Chi | |
| 7,409,894 | B1 * | 8/2008 | Valentine | 81/63.1 |
| 7,467,574 | B1 | 12/2008 | Lin | |
| 7,467,575 | B2 | 12/2008 | Lai | |
| 7,565,852 | B2 | 7/2009 | Yu | |
| 7,571,517 | B2 * | 8/2009 | Smith et al. | 81/177.6 |
| 7,600,640 | B2 | 10/2009 | Hallee et al. | |
| D604,509 | S | 11/2009 | Andrews | |
| 7,698,972 | B2 | 4/2010 | Hi | |
| 7,743,685 | B2 | 6/2010 | Chang | |
| D622,125 | S | 8/2010 | Robinson | |
| D623,037 | S | 9/2010 | Johnson et al. | |
| 7,810,415 | B2 | 10/2010 | Adamany et al. | |
| 7,815,058 | B2 | 10/2010 | Cheng | |
| 7,836,534 | B2 | 11/2010 | Simmons | |
| 7,846,203 | B2 | 12/2010 | Cribier | |
| 7,946,203 | B2 | 5/2011 | Johnson et al. | |
| 8,011,277 | B2 | 9/2011 | Johnson et al. | |
| 8,015,642 | B1 | 9/2011 | Oakley | |
| D650,257 | S | 12/2011 | Royes et al. | |
| 8,336,428 | B2 | 12/2012 | Johnson et al. | |
| 8,613,121 | B1 | 12/2013 | White | |
| 8,640,574 | B2 | 2/2014 | Johnson et al. | |
| 2001/0005576 | A1 | 6/2001 | Rogers et al. | |
| 2001/0045145 | A1 | 11/2001 | Legg | |
| 2003/0047474 | A1 | 3/2003 | Dahlson | |
| 2003/0126957 | A1 | 7/2003 | Huang | |
| 2003/0136234 | A1 | 7/2003 | Cunningham | |
| 2003/0188610 | A1 | 10/2003 | Lin | |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0199108 | A1 * | 9/2005 | Jheng | 81/177.5 |
| 2005/0229752 | A1 | 10/2005 | Nickipuck | |
| 2005/0247587 | A1 | 11/2005 | Holland-Letz | |
| 2005/0268752 | A1 | 12/2005 | Johnson et al. | |
| 2005/0268754 | A1 | 12/2005 | Fa | |
| 2005/0284267 | A1 | 12/2005 | Liao et al. | |
| 2006/0042428 | A1 | 3/2006 | Chuang | |
| 2006/0101955 | A1 | 5/2006 | Chang | |
| 2006/0118500 | A1 | 6/2006 | Chen | |
| 2006/0150784 | A1 | 7/2006 | Hsieh | |
| 2006/0213059 | A1 | 9/2006 | Eggert | |
| 2006/0254396 | A1 | 11/2006 | Hu | |
| 2006/0288531 | A1 | 12/2006 | Hu | |
| 2006/0288823 | A1 | 12/2006 | Schepman | |
| 2007/0023306 | A1 | 2/2007 | Lai | |
| 2007/0044598 | A1 | 3/2007 | Frohm et al. | |
| 2007/0056117 | A1 | 3/2007 | Gardiner et al. | |
| 2007/0056872 | A1 | 3/2007 | Begim | |
| 2007/0062831 | A1 | 3/2007 | Chen | |
| 2007/0084740 | A1 | 4/2007 | Malek | |
| 2007/0141885 | A1 | 6/2007 | Chen | |
| 2007/0151402 | A1 | 7/2007 | Schneeman et al. | |
| 2007/0186731 | A1 | 8/2007 | Schnarr et al. | |
| 2007/0221017 | A1 | 9/2007 | Heaven | |
| 2007/0228672 | A1 | 10/2007 | Huang | |
| 2007/0245862 | A1 | 10/2007 | Gonzalez et al. | |
| 2007/0295171 | A1 | 12/2007 | Johnson et al. | |
| 2008/0128370 | A1 | 6/2008 | Shih | |
| 2008/0148909 | A1 | 6/2008 | Lai | |
| 2008/0156754 | A1 | 7/2008 | Cheng | |
| 2008/0164171 | A1 | 7/2008 | Meng | |
| 2008/0190249 | A1 | 8/2008 | Yu | |
| 2008/0202963 | A1 | 8/2008 | Liao | |
| 2008/0223179 | A1 | 9/2008 | Nash et al. | |
| 2008/0251402 | A1 | 10/2008 | Chiu | |
| 2008/0256816 | A1 | 10/2008 | Cosentino | |
| 2008/0271573 | A1 | 11/2008 | Lown et al. | |
| 2008/0295657 | A1 | 12/2008 | Cluthe | |
| 2009/0107303 | A1 | 4/2009 | Steinweg et al. | |
| 2009/0183608 | A1 | 7/2009 | Johnson et al. | |
| 2009/0183609 | A1 | 7/2009 | Johnson et al. | |
| 2009/0241740 | A1 | 10/2009 | Heagerty | |
| 2010/0258465 | A1 | 10/2010 | Gomas | |
| 2011/0000024 | A1 | 1/2011 | Johnson et al. | |
| 2011/0094910 | A1 | 4/2011 | Fleury et al. | |
| 2012/0012485 | A1 | 1/2012 | Wang | |
| 2013/0228484 | A1 | 9/2013 | Yang | |

FOREIGN PATENT DOCUMENTS

| | | | |
|---|---|---|---|
| CN | 2628230 | Y | 7/2004 |
| DE | 464002 | | 8/1928 |
| DE | 24 53 480 | | 5/1976 |
| DE | 37 44 176 | | 8/1989 |
| DE | 102004011892 | | 1/2005 |
| DE | 20 2007 003841 | U1 | 9/2007 |
| EP | 503 559 | | 9/1992 |
| EP | 618 046 | | 10/1994 |
| EP | 01693163 | | 2/2006 |
| EP | 01777042 | | 4/2007 |
| FR | 787 512 | | 9/1935 |
| GB | 856 223 | | 12/1960 |
| JP | 55-045442 | U | 3/1980 |
| JP | 57-13165 | | 1/1982 |
| JP | 61136778 | | 6/1986 |
| JP | 3-47775 | | 5/1991 |
| JP | 03103162 | | 10/1991 |
| JP | 4-29368 | | 3/1992 |
| JP | 5-31882 | | 4/1993 |
| JP | 08505812 | | 6/1996 |
| WO | 83/01406 | | 4/1983 |
| WO | 9412322 | A1 | 6/1994 |
| WO | 9623631 | | 8/1996 |
| WO | 97/29887 | | 8/1997 |

* cited by examiner

HANDLED RATCHETING TOOL WITH A FLIP OUT HANDLE

FIELD OF THE INVENTION

The present invention relates to hand tools. More specifically, the present invention relates to a handled ratcheting tool which is able to be configured in several different handle configurations.

BACKGROUND OF THE INVENTION

T handle tools have a T-shaped body, including a long leg member and a short handle member. T handles usually have hexagonal-shaped tips for use with screws and other objects designed to accept a hexagonal tip. Once inserted, rotational pressure is applied to the hexagonal wrench in order to tighten or loosen the screw. The leg member and handle of the hexagonal wrench are designed to be in the shape of the letter "T" so that a user is able to grasp the handle with his hand(s) more comfortably.

T handle tools are manufactured and distributed in multiple English and metric sizes in order to facilitate their use with screw heads of multiple sizes. Such tools are usually sold in a set which includes tools of multiple sizes but are also distributed individually.

When using a T handle tool, a user will insert a leg end of the T handle tool onto the head of a workpiece such as a hexagonal screw, and will then exert rotational pressure using the handle on the handle end of the tool in order to tighten or loosen the screw.

While the T handle tool is very helpful, there are instances due to space constrictions, that a T handle orientation is not usable and a modified orientation is needed for a hard to reach screw.

SUMMARY OF THE INVENTION

A handled ratcheting tool is able to be used in a standard, L handle or T handle orientation. The handled ratcheting tool includes a handle, a stem, a ratcheting mechanism and multiple tools. Multiple arms are coupled to the ratcheting mechanism which are able to form the L and T configurations depending on which arms are positioned in an open position and which are in a closed position.

In one aspect, a device comprises a handle element including a stem element, a tool coupled to the stem element, a ratcheting element coupled to the handle element and a plurality of arms coupled to the ratcheting element, the plurality of arms configurable in a screwdriver mode, a T-handle mode and an L-handle mode. The plurality of arms are configured to be positioned against the handle element when configured in a closed position. The tool is detachably coupled to the stem element. The ratcheting element includes a switch for toggling a ratcheting direction. The device further comprises a hinge configured for coupling each of the plurality of arms to the ratcheting element. The screwdriver mode includes the plurality of arms positioned against the handle element in a closed position. The T-handle mode includes the plurality of arms positioned approximately perpendicular to the handle element in an open position. The L-handle mode includes one of the plurality of arms positioned approximately perpendicular to the handle element in an open position. The tool and the plurality of arms are configured to be utilized with a screw or a bolt. The screw or the bolt has a slotted, a Phillips, a hexagonal or a star head. The device comprises rubber, plastic, polymers, metal or a combination thereof.

In another aspect, a method of utilizing a device comprises configuring the device into any of three modes, the modes including a screwdriver mode, a T-handle mode and an L-handle mode and using the device in the configured mode. The device comprises a handle element including a stem element, a tool coupled to the stem element, a ratcheting element coupled to the handle element and a plurality of arms coupled to the ratcheting element, the plurality of arms configurable in the screwdriver mode, the T-handle mode and the L-handle mode. Configuring the device into the screwdriver mode includes orienting the plurality of arms against the handle element. Configuring the device into the T-handle mode includes orienting the plurality of arms to an open position approximately perpendicular to the handle element. Configuring the device into the L-handle mode includes orienting one of the plurality of arms to an open position approximately perpendicular to the handle element. The plurality of arms are configured to be positioned against the handle element when configured in a closed position. The tool is detachably coupled to the stem element. The ratcheting element includes a switch for toggling a ratcheting direction. The device further comprises a hinge for each of the plurality of arms, the hinge for coupling each of the plurality of arms to the ratcheting element. The tool and the plurality of arms are configured to be utilized with a screw or a bolt. The screw or the bolt has a slotted, a Phillips, a hexagonal or a star head. The device comprises rubber, plastic, polymers, metal or a combination thereof.

In another aspect, a method of manufacturing a device comprises forming a set of components including a handle element, a stem element, a ratcheting mechanism, a first arm, a second arm and a tool and coupling the set of components including coupling the ratcheting mechanism to the handle element, coupling the stem element to the ratchet mechanism, coupling the first arm to the ratcheting mechanism, coupling the second arm to the ratcheting mechanism and coupling the tool to the stem element. The handle element is formed so the first and second arms are able to be positioned against the handle element. The first arm, the second arm and the tool are formed as screwdrivers, hex/allen wrenches, star wrenches or a combination thereof. The first arm and the second arm are coupled to the ratcheting mechanism at hinges to enable rotation between a closed position and an open position. The tool is detachably coupled to the stem element. The device is configurable in a screwdriver mode, a T-handle mode and an L-handle mode. The ratcheting element includes a switch for toggling a ratcheting direction. The tool is configured to be utilized with a screw or a bolt. The screw or the bolt has a slotted, a Phillips, a hexagonal or a star head. The device comprises rubber, plastic, polymers, metal or a combination thereof.

In yet another aspect, a device comprises a handle element including a stem element, a tool detachably coupled to the stem element, a ratcheting element coupled to the handle element and a plurality of tools coupled to the ratcheting element, each of the plurality of tools coupled at a hinge, the plurality of tools configurable in a screwdriver mode wherein the plurality of tools are positioned against the handle element in a closed position, a T-handle mode wherein the plurality of tools are positioned approximately perpendicular to the handle element in an open position and an L-handle mode wherein one of the plurality of tools is positioned approximately perpendicular to the handle element in the open position.

DETAILED DESCRIPTION

A handled ratcheting tool with flip out handle enables a user to use the handle in a standard configuration, an L handle configuration and also a T handle configuration providing a very versatile tool.

Figure 1:
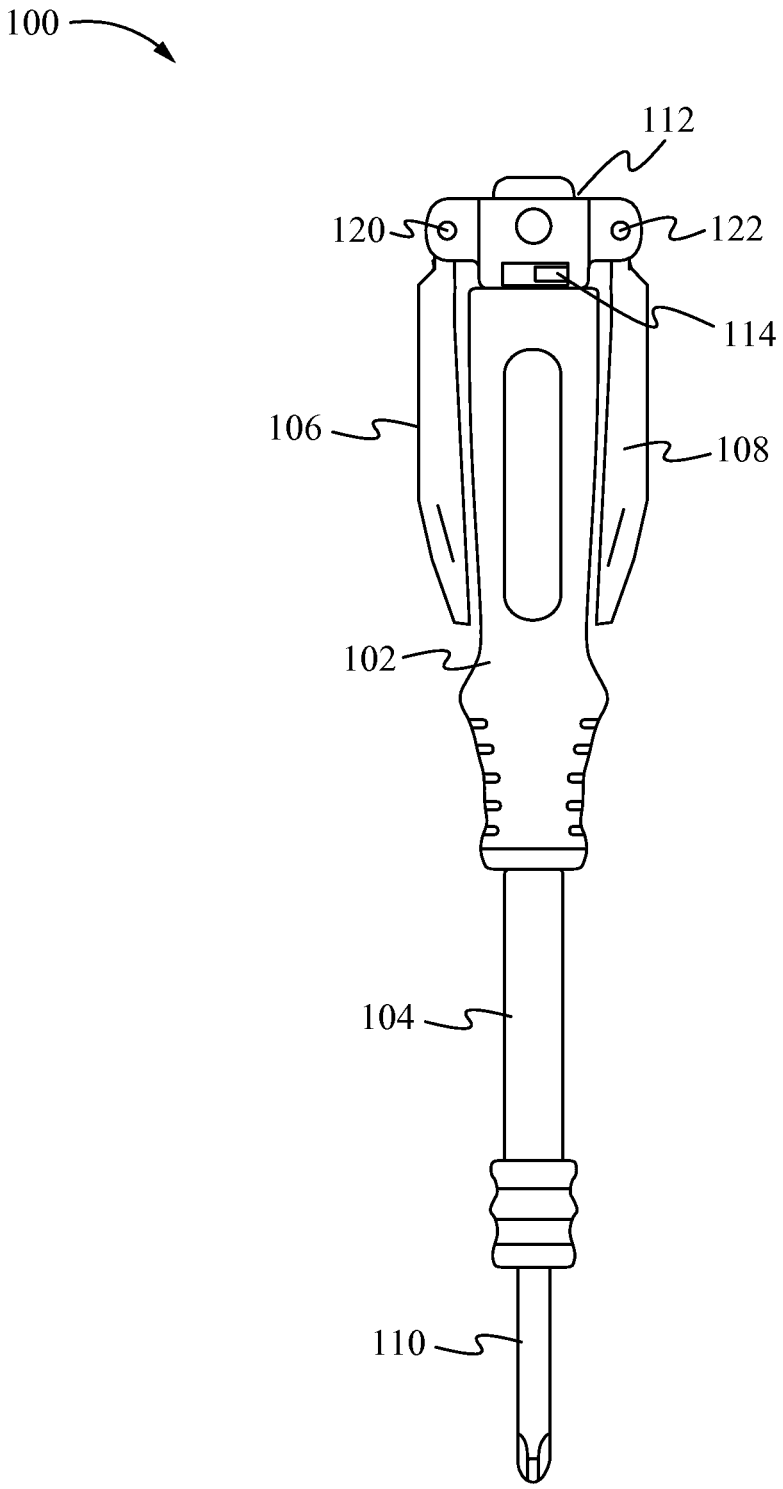
FIG. 1 illustrates a side view of a handled ratcheting tool in a screwdriver mode in accordance with an embodiment.

FIG. 1 illustrates a side view of a handled ratcheting tool 100 in a screwdriver mode. Although referred to as screwdriver mode, screwdriver mode is able to be used with any device (screw, bolt and others) and also is able to be used with any type of driving device (hex, slotted, star, Phillips, sockets and others). The handled ratcheting tool 100 includes a handle 102, a stem 104, a first arm 106, a second arm 108, a tool 110, a ratcheting mechanism 112 and a switch 114.

The handle 102 is configured for a user to be able to grip the handle 102. In some embodiments, the handle 102 is configured for the first arm 106 and the second arm 108 to fit against and/or within the handle 102. The stem 104 is coupled to the handle 102. In some embodiments, the stem 104 includes the tool 110 affixed at the end of the stem 104. In some embodiments, the stem 104 is configured to receive removable tools 110 which are able to be inserted and removed as desired. The first arm 106 and the second arm 108 are coupled to the end of the handle 102. The first arm 106 and the second arm 108 are coupled on opposite sides of the handle 102, each by a hinge 120, 122 or other mechanism that permits rotation. In some embodiments, the first arm 106 and the second arm 108 comprise a straight bottom portion and a bent top portion. In these embodiments, the straight bottom portion of the first arm 106 and the second arm 108 is against the handle 102 in a closed position. The first arm 106 and the second arm 108 are configured to be able to rotate to a T-handle configuration or an L-handle configuration. The ratcheting mechanism 112 is included at the end of the handle 102 as well. The ratcheting mechanism 112 allows the handle 102 to be turned similar to any ratchet device when the handled ratcheting tool 100 is configured in the T-handle configuration. In some embodiments, the ratcheting mechanism is able to be used in configurations other than the T-handle configuration. The ratcheting mechanism 112 includes a switch 114 or other feature which enables the rotation of the ratcheting mechanism 112 to be toggled between forward, reverse, and, in some embodiments, a "lock" mode for use as a direct drive screwdriver with no ratcheting.

When the handled ratcheting tool 100 is in the screwdriver mode, the handled ratcheting tool 100 is used in the same manner as a screwdriver. The first arm 106 and the second arm 108 are configured in the closed position against and/or within the handle 102, so that the user is able to place his/her hand around the handle 102 and the first arm 106 and the second arm 108. The user is then able to turn the handled ratcheting tool 100 in the same manner as a screwdriver.

Figure 2:
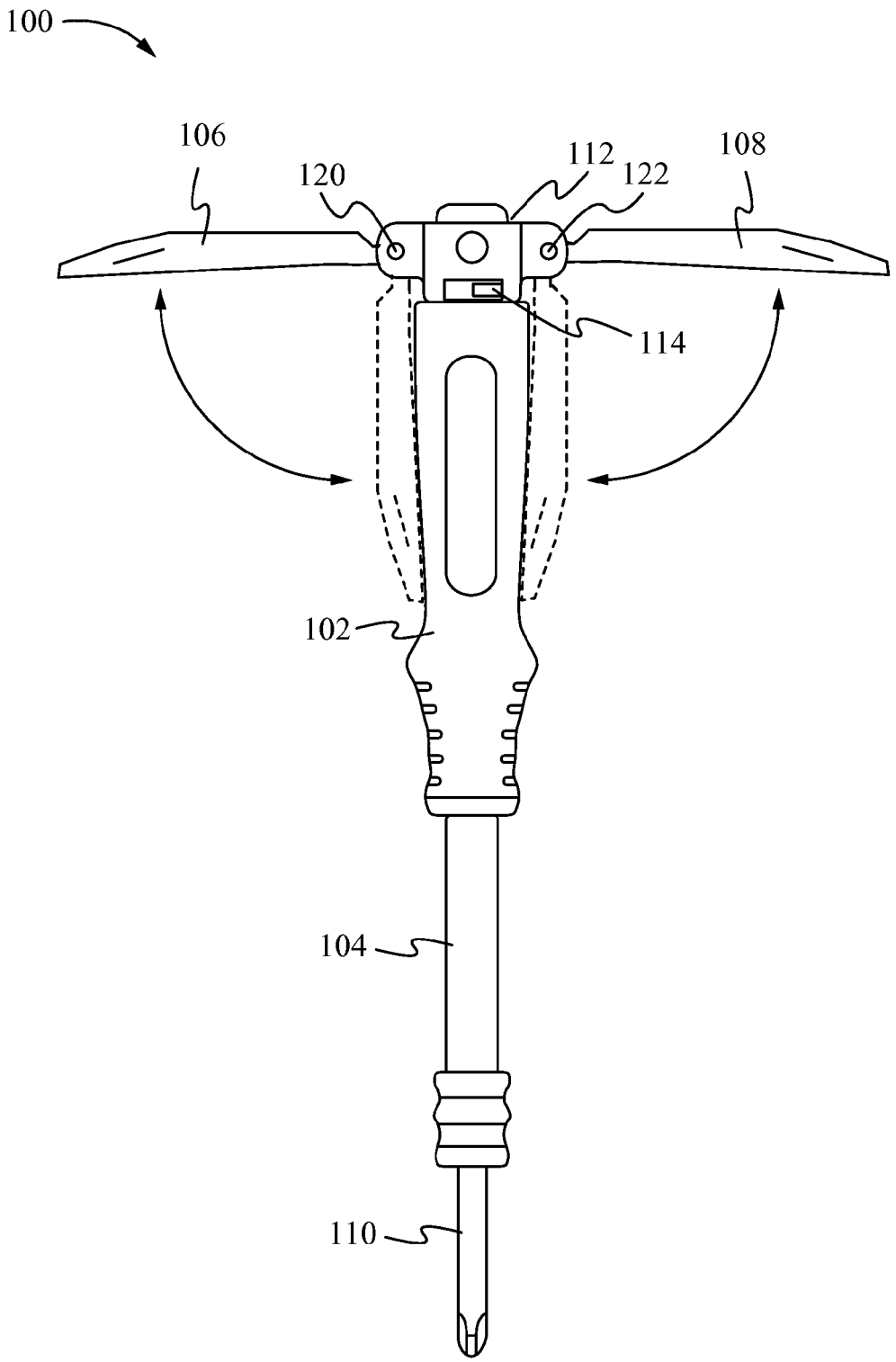
FIG. 2 illustrates a side view of a handled ratcheting tool in a T-handle mode in accordance with an embodiment.

FIG. 2 illustrates a side view of a handled ratcheting tool 100 in a T-handle mode in accordance with an embodiment. When the first arm 106 and the second arm 108 are configured perpendicular to the handle 102 (also referred to as the open position), the handled ratcheting tool 100 is configured in the T-handle mode.

When the handled ratcheting tool 100 is in the T-handle mode, the handled ratcheting tool 100 is used in the same manner as a T-handle tool. A user is able to grasp the handled ratcheting tool 100 in a manner that the first arm 106 and the second arm 108 are able to provide additional torque when turning the handled ratcheting tool 100. The T-handle mode allows the user to install or remove an object such as a screw when the screwdriver mode provides insufficient leverage.

The ratcheting mechanism 112 is included at the end of the handle 102 to allow the handle 102 to be turned similar to any ratchet device when the handled ratcheting tool 100 is configured in the T-handle configuration. The ratcheting mechanism 112 includes a switch 114 which enables the rotation of the ratcheting mechanism 112 to be toggled for either installing or removing an object such as a screw.

Figure 3:
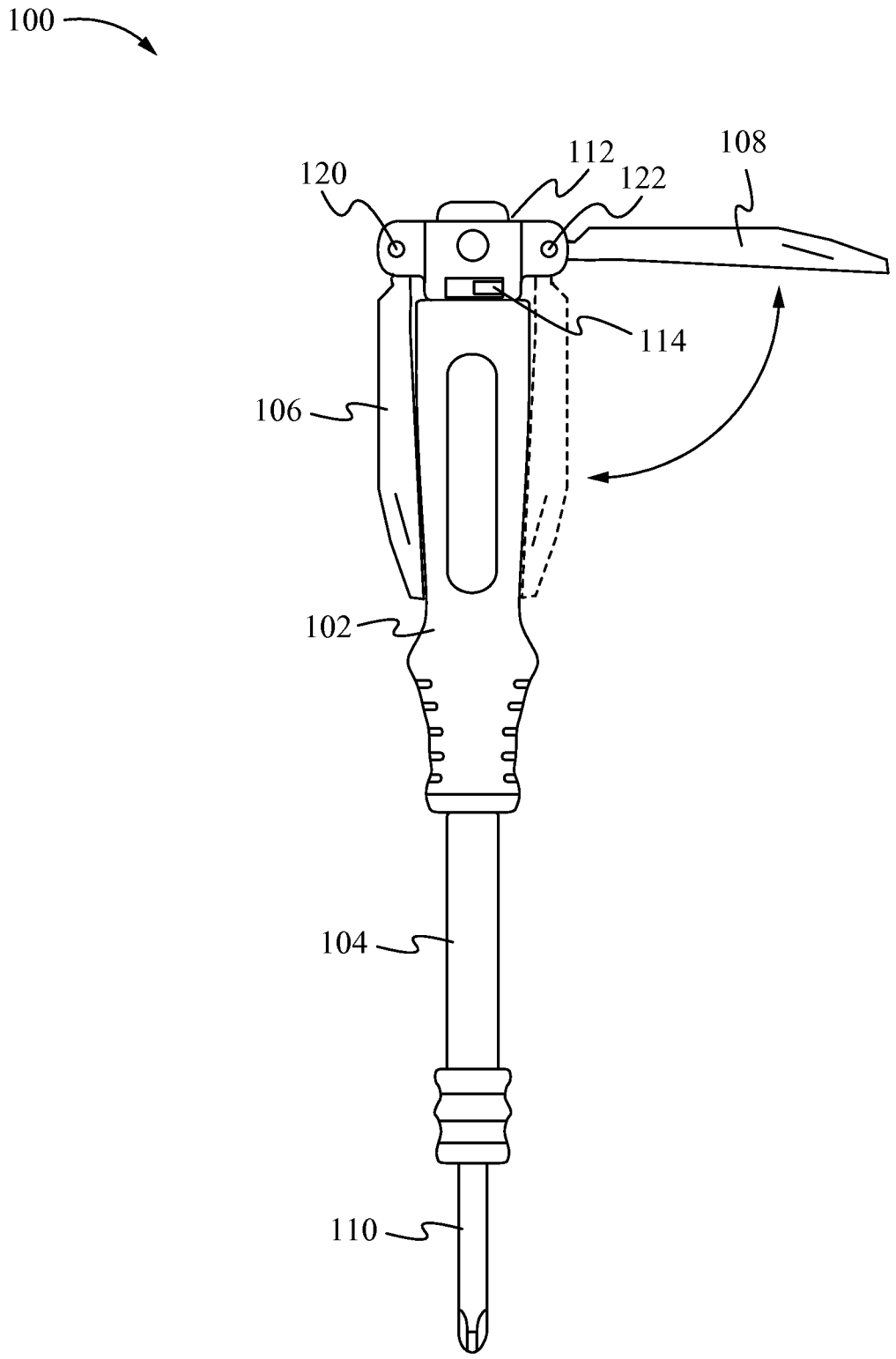
FIG. 3 illustrates a side view of a handled ratcheting tool in an L-handle mode in accordance with an embodiment.

FIG. 3 illustrates a side view of a handled ratcheting tool in an L-handle mode in accordance with an embodiment. The L-handle mode is when either the first arm 106 or the second arm 108 is configured perpendicular to the handle 102 (open position), and the other of the first arm 106 or the second arm 108 is configured against and/or within the handle 102 (closed position).

When the handled ratcheting tool 100 is in the L-handle mode, the handled ratcheting tool 100 is used in the same manner as an L-handle tool. A user is able to grasp the handled ratcheting tool 100 at the handle 102 with the arm such as the second arm 108 facing the object to be manipulated (such as tightened or loosened). For additional torque, the user is able to grasp the handled ratcheting tool 100 at the stem 104 or even at the tool 110. The L-handle mode allows the user to install or remove an object such as a screw when the screwdriver mode is insufficient due to leverage or when there is not sufficient room to grasp the T-handle mode.

Figure 4:
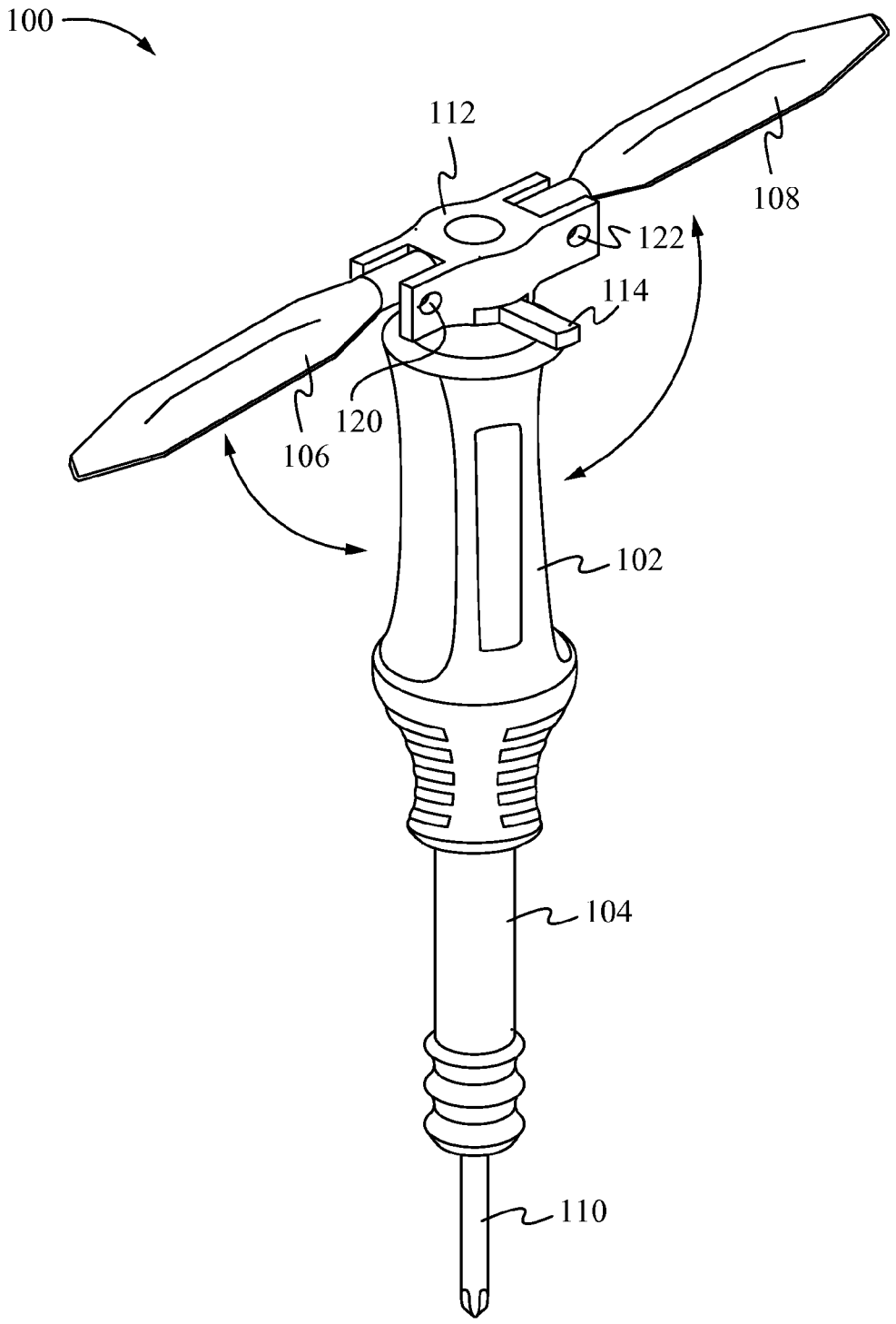
FIG. 4 illustrates a perspective view of a handled ratcheting tool in a T-handle mode in accordance with an embodiment.

FIG. 4 illustrates a perspective view of a handled ratcheting tool 100 in a T-handle mode in accordance with an embodiment. As described above, the handled ratcheting tool 100 is put into the T-handle mode by orienting, such as rotating, the first arm 106 and the second arm 108 to an open position where each arm is perpendicular to the handle 102.

Figure 5:
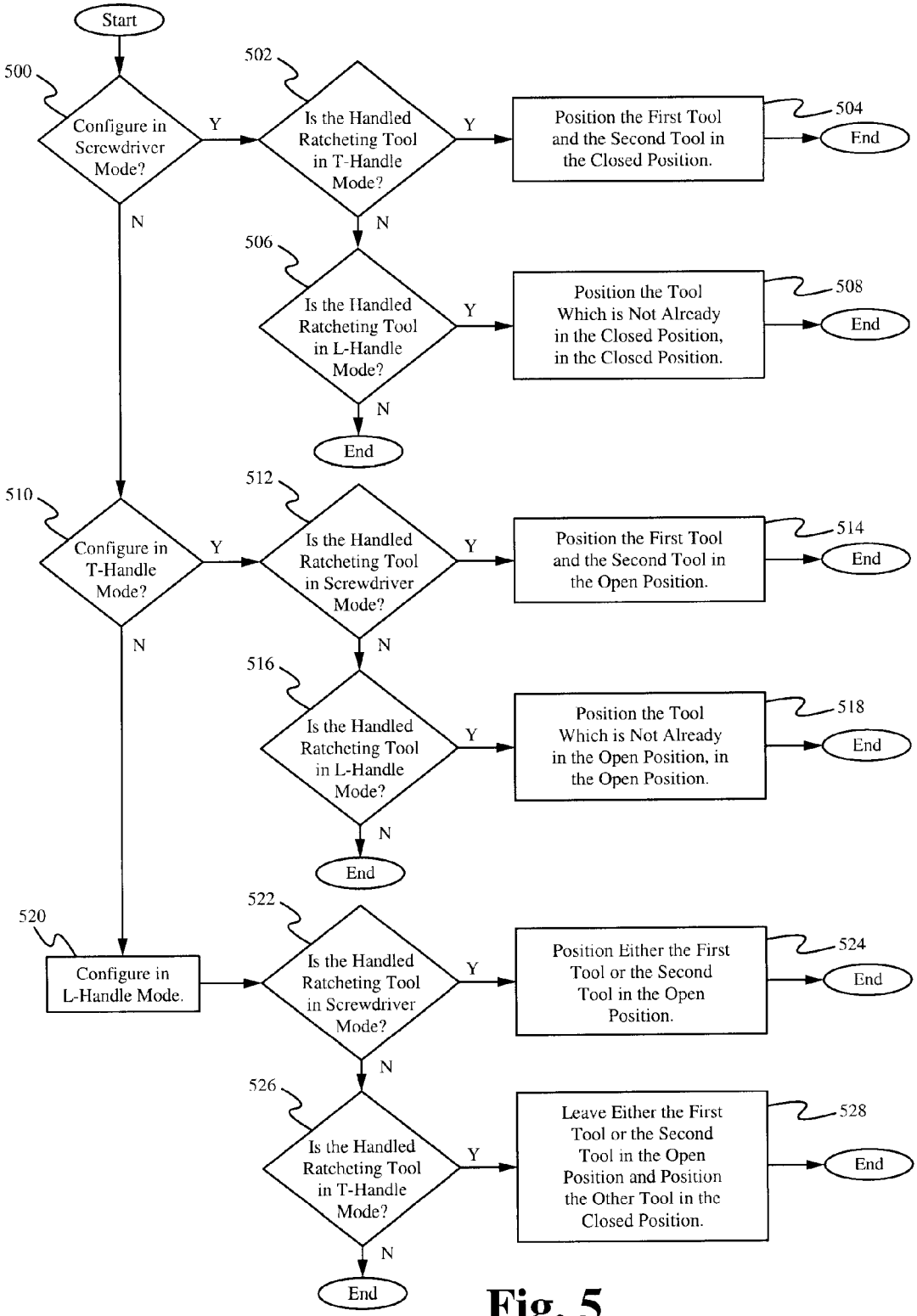
FIG. 5 illustrates a flowchart of methods of configuring a handled ratcheting tool in accordance with an embodiment.

FIG. 5 illustrates a flowchart of methods of configuring a handled ratcheting tool in accordance with an embodiment. In the step 500, it is determined if a user wants to configure the handled ratcheting tool into the screwdriver mode. If the user wants to configure the handled ratcheting tool into the screwdriver mode, then it is determined if the handled ratcheting tool is in the T-handle mode, in the step 502. If the handled ratcheting tool is in the T-handle mode, then the first arm and the second arm are moved/rotated/positioned into the closed position, in the step 504. If it is determined that the handled ratcheting tool is in the L-handled mode, in the step 506, then the arm (either the first or second) which is not already in the closed position is moved/rotated/positioned in the closed position, in the step 508. In the step 510, it is determined if a user wants to configure the handled ratcheting tool into the T-handle mode. If the user wants to configure the handled ratcheting tool into the T-handle mode, then it is determined if the handled ratcheting tool is in the screwdriver mode, in the step 512. If the handled ratcheting tool is in the screwdriver mode, then the first arm and the second arm are moved/rotated/positioned into the open position, in the step 514. If the handled ratcheting tool is in the L-handle mode in the step 516, then the arm (either the first or the second arm) which is not already in the open position is moved/rotated/positioned in the open position, in the step 518. In the step 520, the user wants to configure the handled ratcheting tool into the L-handle mode. In the step 522, it is determined if the handled ratcheting tool is in the screwdriver mode. If the handled ratcheting tool is in the screwdriver mode, then either the first arm or the second arm is moved/rotated/positioned in the open position, in the step 524. If the handled ratcheting tool is in the T-handle mode, in the step 526, then either the first arm or the second arm is left in the open position and the other arm is moved/rotated/positioned in the closed position, in the step 528. Once the handled ratcheting tool is configured into the desired mode or configuration, the user uses the tool by appropriately grasping the correct portion of the tool for use. For example, in the screwdriver mode, the user grasps the handle portion including the closed first arm and second arm. In the T-handle mode, the user places his/her fingers around the first arm and the second arm. When using the T-handle mode, the user is able to utilize the ratcheting mechanism which includes a switch to toggle the direction of the ratcheting mechanism. In the L-handle mode, the user grasps the tool at either the handle, the stem or the tool.

Figure 6:
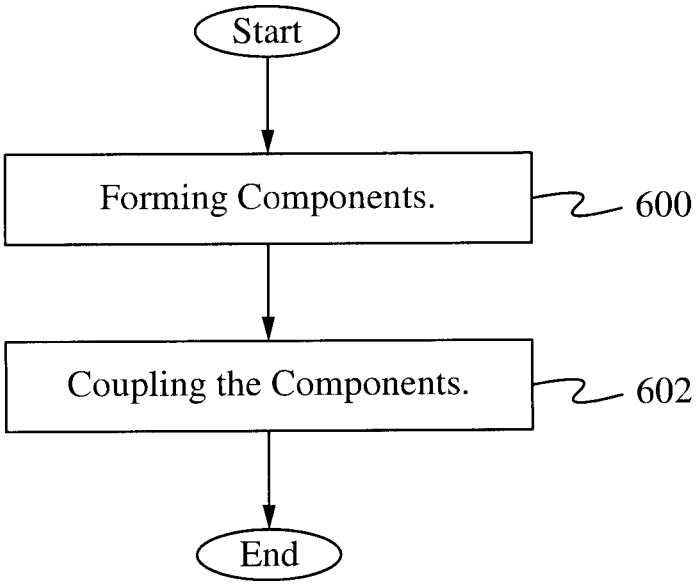
FIG. 6 illustrates a flowchart of a method of manufacturing a handled ratcheting tool in accordance with an embodiment.

FIG. 6 illustrates a flowchart of a method of manufacturing a handled ratcheting tool in accordance with an embodiment. In the step 600, components are formed. In some embodiments, the components include a handle, a stem, a ratcheting mechanism and multiple arms and or tool(s). In some embodiments, the handle and ratcheting mechanism are formed as one piece or as two pieces. The handle is formed so that a user is able to grip the handle easily and also so the first and second arms are able to fit against and/or within the handle. The arms are formed depending on the desired tool implementation. In some embodiments, the arms are able to be formed as screwdrivers, hex/allen wrenches, star wrenches or other tools. In the step 602, the components are coupled together. Coupling the components includes coupling the ratcheting mechanism to the handle, coupling the stem to the ratcheting mechanism, coupling the first arm to the ratcheting mechanism, coupling the second arm to the ratcheting mechanism and in some embodiments, detachably coupling the tool to the stem. The first arm and the second arm are coupled to the ratcheting mechanism at hinges so that they are able to orient/move/rotate between a closed position and an open position.

Figure 7:
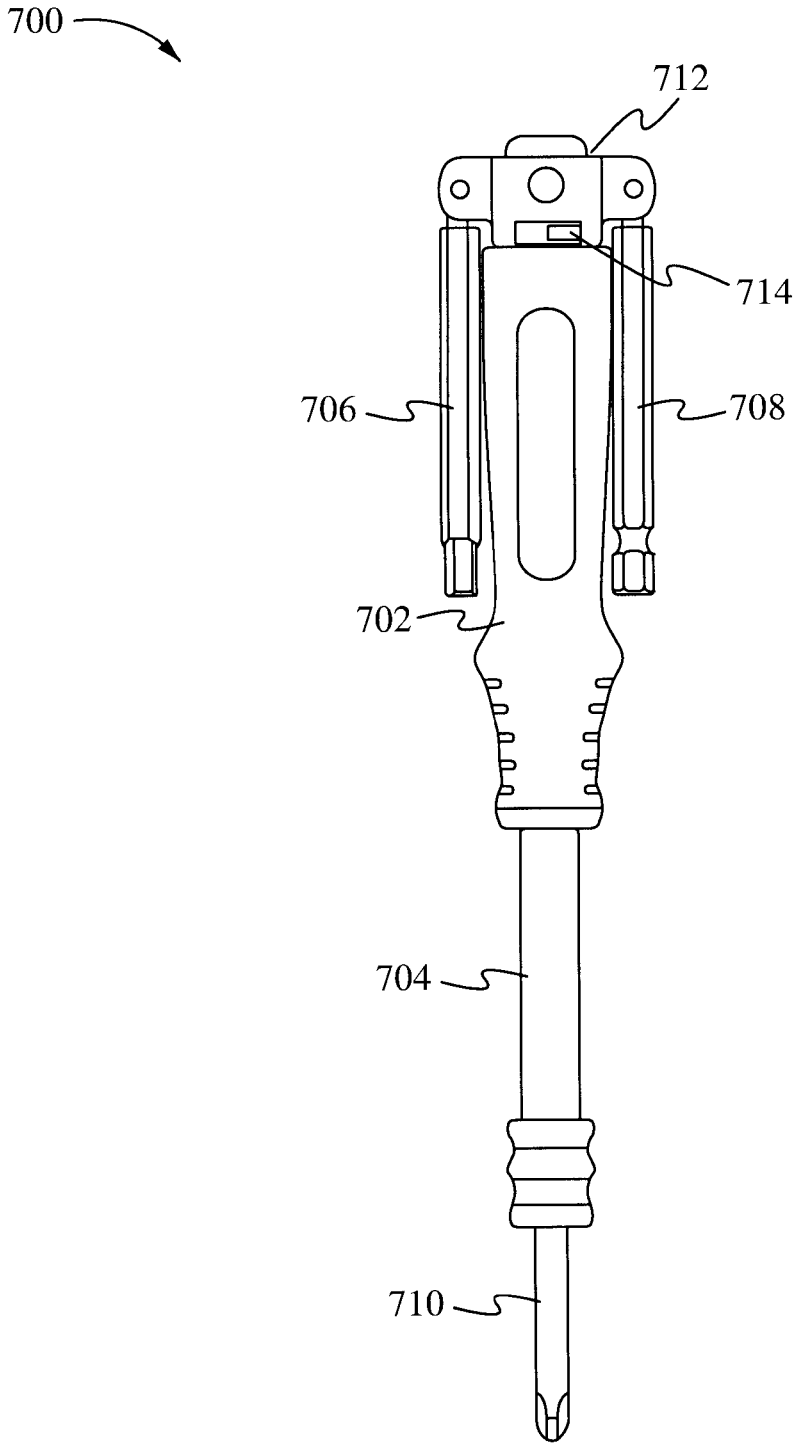
FIG. 7 illustrates a side view of a handled ratcheting tool in a screwdriver mode in accordance with an embodiment.

FIG. 7 illustrates a side view of a handled ratcheting tool 700 in a screwdriver mode. Although referred to as screwdriver mode, screwdriver mode is able to be used with any device (screw, bolt and others) and also is able to be used with any type of driving device (hex, slotted, star, Phillips, sockets and others). The handled ratcheting tool 700 includes a handle 702, a stem 704, a first tool 706, a second tool 708, a third tool 710, a ratcheting mechanism 712 and a switch 714.

The handle 702 is configured for a user to be able to grip the handle 702. In some embodiments, the handle 702 is configured for the first tool 706 and the second tool 708 to fit against and/or within the handle 702. The stem 704 is coupled to the handle 702. In some embodiments, the stem 704 includes the third tool 710 affixed at the end of the stem 704. In some embodiments, the stem 704 is configured to receive removable third tools 710 which are able to be inserted and removed as desired. The first arm 706 and the second arm 708 are coupled to the end of the handle 702. The first arm 706 and the second arm 708 are coupled on opposite sides of the handle 702, each by a hinge or other mechanism that permits rotation. The first arm 706 and the second arm 708 are configured to be able to rotate to a T-handle configuration or an L-handle configuration. The ratcheting mechanism 712 is included at the end of the handle 702 as well. The ratcheting mechanism 712 allows the handle 702 to be turned similar to any ratchet device when the handled ratcheting tool 700 is configured in the T-handle configuration. In some embodiments, the ratcheting mechanism is able to be used in configurations other than the T-handle configuration. The ratcheting mechanism 712 includes a switch 714 which enables the rotation of the ratcheting mechanism 712 to be toggled.

When the handled ratcheting tool 700 is in the screwdriver mode, the handled ratcheting tool 700 is used in the same manner as a screwdriver. The first tool 706 and the second tool 708 are configured in the closed position against and/or within the handle 702, so that the user is able to place his/her hand around the handle 702 and the first tool 706 and the second tool 708. The user is then able to turn the handled ratcheting tool 700 in the same manner as a screwdriver.

Figure 8:
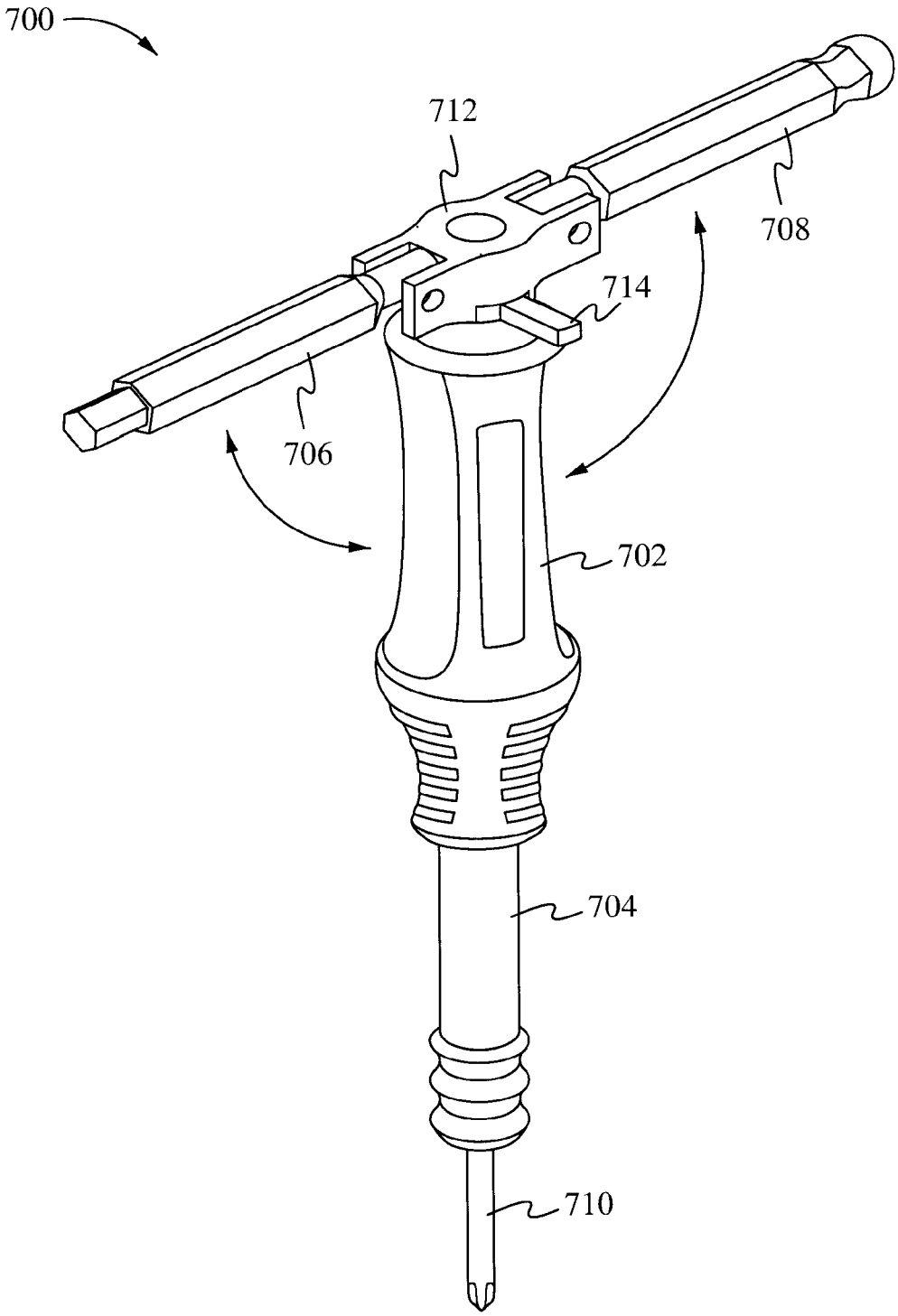
FIG. 8 illustrates a perspective view of a handled ratcheting tool in a T-handle mode in accordance with an embodiment.

FIG. 8 illustrates a perspective view of a handled ratcheting tool 700 in a T-handle mode in accordance with an embodiment. As described above, the handled ratcheting tool 700 is put into the T-handle mode by rotating the first tool 706 and the second tool 708 to an open position where each tool is perpendicular to the handle 702.

The handled ratcheting tool is able to be composed of any material. In some embodiments, the tool is a combination of materials such as metal, plastic, polymers and rubber. The handled ratcheting tool is able to be any size.

The handled ratcheting tool is able to be used with any type of device such as bolts, screws, connections and other devices with any type of drive type such as various sized slotted screws, Phillips-head screws, hexagonal screws/bits, star screws/bits, pozidriv bits, torx bits, allen wrenches and screws, hex key bits, Robertson bits, tri-wing bits, Torx, torq-sets, spanner bits, drill bits, sockets of various shapes and sizes or the like.

In some embodiments, the handled ratcheting tool does not have a ratcheting mechanism and the tools are coupled to the handle.

In some embodiments, instead of two tools coupled to the ratcheting mechanism, three, four or more tools are coupled to the ratcheting mechanism.

In some embodiments, the tools are the same type but different sizes (e.g. ⅜" hex, ¼" hex, or others). In some embodiments, the tools are different types and the same size (e.g. hex, star, slotted). In some embodiments, the tools are different types and different sizes.

In some embodiments, the handled ratcheting tool is able to used in a modified-L or modified-T configuration, which is similar to the L or T configuration, but not approximately perpendicular. For example, the L configuration includes an approximately 90° angle between the tool and the handle, but a modified-L configuration includes a 75° angle between the tool and the handle.

In some embodiments, the arms are able to be locked in position in closed, partially open and fully open positions. In some embodiments, the arms are able to be locked in a fully open position but not in other positions. In some embodiments, the arms are able to be locked in any position.

In some embodiments, the first arm and the second arm are detachably coupled to the ratcheting mechanism or the handle.

To utilize the handled ratcheting tool, a user initially configures the handle in a desired orientation. The user is able to configure the handle into a standard, L handle or T handle configuration. Once in the desired orientation, the user is able to grasp the handle accordingly. The user uses the handle similarly to any other tool or ratchet tool for tightening or loosening screws, bolts or other items.

In operation, the handled ratcheting tool allows a user to reach items such as screws, bolts or other items that are not able to be reached by standard tools. For example, if a screw is tucked away in a partially enclosed area, the handle is able to be modified into an L handle orientation to allow the user to reach the item with the handle and perform the desired task. Furthermore, the handle is able to be configured in a T-handle orientation to provide a user with a better grip on the handle. The different configurations, standard, L handle and T handle enable one handle to be able to used for many different tasks and reduces the number of tools required by a user.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A device comprising:

a. a handle element having a generally cylindrical shape forming an outer perimeter, a first end and a second end, the handle element including a stem element at said first end;

b. a tool detachably inserted within the stem element;

c. a ratcheting element coupled to said second end of the handle element comprising a switch extending from the ratcheting element positioned adjacent said second end of the handle toggable between an un-lock position for toggling the ratcheting element in a ratcheting direction and lock position for locking the ratcheting element in a non-ratcheting position; and d. a plurality of arms each comprising a straight bottom portion and a bent top portion directly coupled to the ratcheting element, the plurality of arms configurable in a screwdriver mode, a T-handle mode and an L-handle mode, wherein the arms are configured to be locked in position in closed, partially open and fully open positions, and wherein the plurality of arms are folded with the straight bottom portion against an outermost surface of the outer perimeter of the handle element when configured in a closed position.

2. The device of claim 1 further comprising a hinge configured for coupling each of the plurality of arms to the ratcheting element.

3. The device of claim 1 wherein the screwdriver mode includes the plurality of arms positioned against the handle element in a closed position.

4. The device of claim 1 wherein the T-handle mode includes the plurality of arms positioned approximately perpendicular to the handle element in an open position.

5. The device of claim 1 wherein the L-handle mode includes one of the plurality of arms positioned approximately perpendicular to the handle element in an open position.

6. The device of claim 1 wherein the tool is configured to be utilized with a screw or a bolt.

7. The device of claim 6 wherein the screw or the bolt has a slotted, a Phillips, a hexagonal or a star head.

8. The device of claim 1 wherein the device comprises rubber, plastic, polymers, metal or a combination thereof.

9. A method of utilizing a device comprising:

a. providing a device comprising a handle element having a generally cylindrical shape forming an outer perimeter, a first end and a second end, the handle element including a stem element at said first end; a ratcheting element coupled to said second end of the handle element comprising a switch extending from the ratcheting element positioned adjacent said second end of the handle toggable between an un-lock position for toggling the ratcheting element in a ratcheting direction and lock position for locking the ratcheting element in a non-ratcheting position; and a plurality of arms each comprising a straight bottom portion and a bent top portion directly coupled to the ratcheting element, the plurality of arms configurable in a screwdriver mode, a T-handle mode and an L-handle mode, wherein the arms are configured to be locked in position in closed, partially open and fully open positions and wherein the plurality of arms are foldable with the straight bottom portion against an outermost surface of the outer perimeter of the handle element when configured in a closed position;

b. configuring the device into any of a screwdriver mode, a T-handle mode and an L-handle mode;

c. detachably inserting a tool within the stem of the device;

d. toggling the ratcheting element between a ratcheting position and a non-ratcheting position; and e. using the device in the configured mode.

10. The method of claim 9 wherein configuring the device into the T-handle mode includes orienting the plurality of arms to an open position approximately perpendicular to the handle element.

11. The method of claim 9 wherein configuring the device into the L-handle mode includes orienting one of the plurality of arms to an open position approximately perpendicular to the handle element.

12. The method of claim 9 wherein the plurality of arms are configured to be positioned against the handle element when configured in a closed position.

13. The method of claim 9 wherein the device further comprises a hinge for each of the plurality of arms, the hinge for coupling each of the plurality of arms to the ratcheting element.

14. The method of claim 9 wherein the tool is configured to be utilized with a screw or a bolt.

15. The method of claim 14 wherein the screw or the bolt has a slotted, a Phillips, a hexagonal or a star head.

16. The method of claim 9 wherein the device comprises rubber, plastic, polymers, metal or a combination thereof.

17. A method of manufacturing a device comprising:

a. forming a set of components including a handle element having a generally cylindrical shape forming an outer perimeter, a first end and a second end, the handle element including a stem element, a ratcheting element coupled to the handle element comprising a switch extending from the ratcheting element toggable between an un-lock position for toggling the ratcheting element in a ratcheting direction and lock position for locking the ratcheting element in a non-ratcheting position, a first arm comprising a straight bottom portion and a bent top portion, a second arm comprising a straight bottom portion and a bent top portion and a tool; and b. coupling the set of components including:

i. coupling the ratcheting mechanism to said second end of handle element such that the switch is positioned adjacent said second end of the handle;

ii. coupling the stem element to said first end of the handle;

iii. directly coupling the first arm to the ratcheting mechanism;

iv. directly coupling the second arm to the ratcheting mechanism; and v. inserting the tool within the stem element, wherein the handle element is formed so the first and second arms are able to be folded with the straight bottom portion against an outermost surface of the outer perimeter of the handle element and such that the first arm and the second arm are configurable in a screwdriver mode, a T-handle mode and an L-handle mode, further wherein the arms are configured to be locked in position in closed, partially open and fully open positions.

18. The method of claim 17 wherein the tool is formed as screwdrivers, hex/allen wrenches, star wrenches or a combination thereof.

19. The method of claim 17 wherein the first arm and the second arm are coupled to the ratcheting mechanism at hinges to enable rotation between a closed position and an open position.

20. The method of claim 17 wherein the tool is configured to be utilized with a screw or a bolt.

21. The method of claim 20 wherein the screw or the bolt has a slotted, a Phillips, a hexagonal or a star head.

22. The method of claim 17 wherein the device comprises rubber, plastic, polymers, metal or a combination thereof.

23. A device comprising:

a. a handle element having a generally cylindrical shape forming an outer perimeter, a first end and a second end, the handle element including a stem element at said first end;

b. a tool detachably inserted within the stem element;

c. a ratcheting element coupled to said second end of the handle element comprising a switch extending from the ratcheting element positioned adjacent said second end of the handle toggable between an un-lock position for toggling the ratcheting element in a ratcheting direction and a lock position for locking the ratcheting element in a non-ratcheting position; and d. a plurality of arms each comprising a straight bottom portion and a bent top portion directly coupled to the ratcheting element, each of the plurality of arms coupled at a hinge, the plurality of arms configurable in:

i. a screwdriver mode wherein the plurality of arms are folded with the straight bottom portion against an outermost surface of the outer perimeter of the handle element in a closed position;

ii. a T-handle mode wherein the plurality of arms are positioned approximately perpendicular to the handle element in an open position; and iii. an L-handle mode wherein one of the plurality of arms is positioned approximately perpendicular to the handle element in the open position, wherein the arms are configured to be locked in position in closed, partially open and fully open positions.

* * * * *